US005690086A

United States Patent [19]

Kawano et al.

[11] Patent Number: 5,690,086

[45] Date of Patent: Nov. 25, 1997

[54] AIR/FUEL RATIO CONTROL APPARATUS

[75] Inventors: Akihiro Kawano, Sagamihara; Hatsuo Nagaishi, Yokohama; Yoshiaki Yoshioka, Sagamihara, all of Japan

[73] Assignee: Nissan Motor Co., Ltd., Kanagawa, Japan

[21] Appl. No.: 716,844

[22] Filed: Sep. 10, 1996

[30] Foreign Application Priority Data

Sep. 11, 1995 [JP] Japan ..... 7-232575
Sep. 22, 1995 [JP] Japan ..... 7-244997

[51] Int. Cl.[6] ..... F05D 41/14

[52] U.S. Cl. ..... 123/674

[58] Field of Search ..... 123/674, 675, 123/698, 520

[56] References Cited

U.S. PATENT DOCUMENTS

| | | | |
|---|---|---|---|
| 4,821,701 | 4/1989 | Nankee, II et al. | 123/674 |
| 4,977,881 | 12/1990 | Abe et al. | 123/674 |
| 5,090,388 | 2/1992 | Hamburg et al. | 123/674 |
| 5,404,862 | 4/1995 | Ohta et al. | 123/698 |
| 5,423,307 | 6/1995 | Okawa et al. | 123/698 |
| 5,425,349 | 6/1995 | Nagaishi et al. | 123/674 |

FOREIGN PATENT DOCUMENTS 63-41632 2/1988 Japan .

*Primary Examiner*—Willis R. Wolfe
*Attorney, Agent, or Firm*—Lowe, Price, LeBlanc & Becker

[57] ABSTRACT

An apparatus for use with an internal combustion engine having a fuel vapor trap from which fuel vapor is purged into the engine through a purge passage having a purge control valve provided therein. The purge control valve is controlled to permit fuel vapor purge through the purge passage based on the existing engine operating conditions. An air/fuel ratio feedback control correction factor is calculated to correct the air/fuel ratio within a predetermined range based on the air/fuel ratio of the mixture supplied to the engine. A gain value is calculated based on a deviation between the air/fuel ratio feedback correction factor calculated with the fuel vapor purge and the air/fuel ratio feedback correction factor calculated without the fuel vapor purge and a purge rate of the fuel vapor flow rate to the intake air flow rate. The calculated gain values are stored in a memory in respective memory locations addressable by different fuel vapor amounts. The calculated gain value is stored in the memory in a memory location corresponding to the sensed fuel vapor amount to update a gain value stored previously in the memory location. A gain value is read from the memory location corresponding to the fuel vapor amount. The amount of fuel supplied to the engine is controlled according to a target value calculated based on the read gain value and the engine operating conditions.

17 Claims, 11 Drawing Sheets

ON
OFF

APAGE

PRATE

PFR

PFRD

PFRC

SPFRC

EALSFT

α

A/F

AIR/FUEL RATIO CONTROL APPARATUS

BACKGROUND OF THE INVENTION

This invention relates to an air/fuel ratio control apparatus for use with an internal combustion engine having a fuel vapor trap from which fuel vapor is purged into the engine.

It is the current practice to avoid discharge of fuel vapor from the fuel tank to the atmosphere with the use of a fuel vapor trap such as an activated carbon canister for trapping the fuel vapor introduced from the fuel tank into the canister, as disclosed in Japanese Patent Kokai No. 63-41632. Fresh air is introduced into the canister to purge the trapped fuel vapor and introduce the purged fuel vapor, along with the fresh air, into the engine induction passage. In order to correct deviations of the air/fuel ratio from an optimum value due to variations and changes in the fuel injectors and airflow meter with time, the air/fuel ratio is learned to update the last air/fuel ratio for air/fuel ratio feedback control. During the learning control, however, an error will be introduced into the learned air/fuel ratio value when the purged gases are introduced from the canister to the engine. The purged gases contains fuel vapor purged from the canister and also fuel vapor discharged from the fuel tank without trapped in the canister. The amount of the former fuel vapor contained in the purged is substantially proportional directly to the amount of fuel vapor trapped in the canister, whereas the amount of the latter fuel vapor contained in the purged gas is held at a constant value dependent on the fuel temperature, fuel volatility, residual fuel amount and the like regardless of the purge gas flow rate. It is, therefore, impossible to provide correct air/fuel ratio control merely by learning the purge concentrations.

SUMMARY OF THE INVENTION

It is a main object of the invention to provide an improved air/fuel ratio control apparatus which can provide more correct air/fuel ratio control according to engine operating condition changes.

There is provided, in accordance with the invention, an apparatus for use with an internal combustion engine having a throttle valve located in an induction passage for controlling the amount of air supplied to the engine through the induction passage and an exhaust passage through which exhaust gases are discharged from the engine to the atmosphere, to control flow of fuel vapor purged from a fuel vapor trap into the engine through a purge passage having a purge control valve provided therein. The apparatus comprises means for sensing engine operating conditions, means for sensing an amount of air supplied into the engine, means for sensing an air/fuel ratio of an air/fuel mixture supplied to the engine, means for controlling the purge control valve to permit fuel vapor purge through the purge passage based on the sensed engine operating conditions, means for calculating an air/fuel ratio feedback control correction factor to correct the air/fuel ratio within a predetermined range based on the sensed air/fuel ratio, means for sensing an amount of fuel vapor introduced through the purge passage into the engine, means for calculating a purge rate of the sensed fuel vapor amount with respect to the sensed air amount, means for calculating a deviation between the air/fuel ratio feedback correction factor calculated with the fuel vapor purge and the air/fuel ratio feedback correction factor calculated without the fuel vapor purge, means for calculating a gain value based on the calculated purge rate and the calculated air/fuel ratio feedback control correction factor deviation only during the fuel vapor purge, a memory for storing gain values in respective memory locations addressable by different fuel vapor amounts, means for storing the calculated gain value in the memory in a memory location corresponding to the sensed fuel vapor amount to update a gain value stored previously in the memory location, means for reading a gain value stored in the memory in the memory location corresponding to the sensed fuel vapor amount, means for calculating a value for the amount of fuel supplied to the engine based on the read gain value and the sensed engine operating conditions, and means for controlling the amount of fuel supplied to the engine according to the calculated value therefor.

In another aspect of the invention, there is provided an apparatus for use with an internal combustion engine having a throttle valve located in an induction passage for controlling the amount of air supplied to the engine through the induction passage and an exhaust passage through which exhaust gases are discharged from the engine to the atmosphere, to control flow of fuel vapor purged from a fuel vapor trap into the engine through a purge passage having a purge control valve provided therein,. The apparatus comprises means for sensing engine operating conditions, means for sensing an amount of air supplied into the engine, means for sensing an air/fuel ratio of an air/fuel mixture supplied to the engine, means for controlling the purge control valve to permit fuel vapor purge through the purge passage based on the sensed engine operating conditions, means for calculating an air/fuel ratio feedback control correction factor to correct the air/fuel ratio within a predetermined range based on the sensed air/fuel ratio, means for sensing an amount of fuel vapor introduced through the purge passage into the engine, means for calculating a purge rate of the sensed fuel vapor amount with respect to the sensed air amount, means for calculating a deviation between the air/fuel ratio feedback correction factor calculated with the fuel vapor purge and the air/fuel ratio feedback correction factor calculated without the fuel vapor purge, means for calculating a gain value based on the calculated purge rate and the calculated air/fuel ratio feedback control correction factor deviation only during the fuel vapor purge, a memory for storing gain values in respective memory locations addressable by different fuel vapor amounts, means for storing the calculated gain value in the memory in a memory location corresponding to the sensed fuel vapor amount to update a gain value stored previously in the memory location, means for reading a gain value stored in the memory in the memory location corresponding to the sensed fuel vapor amount, means for calculating a shift value by which the air/fuel ratio feedback control correction factor is to be shifted based on the read gain value and the calculated purge rate, means for shifting the air/fuel ratio feedback control correction factor by the calculated shift value, means for calculating a value for the amount of fuel supplied to the engine based on the shifted air/fuel ratio feedback control correction factor and the sensed engine operating conditions, and means for controlling the amount of fuel supplied to the engine according to the calculated value therefor.

BRIEF DESCRIPTION OF THE DRAWINGS

This invention will be described in greater detail by reference to the following description taken in connection with the accompanying drawings, in which.

DETAILED DESCRIPTION OF THE INVENTION

Figure 1:
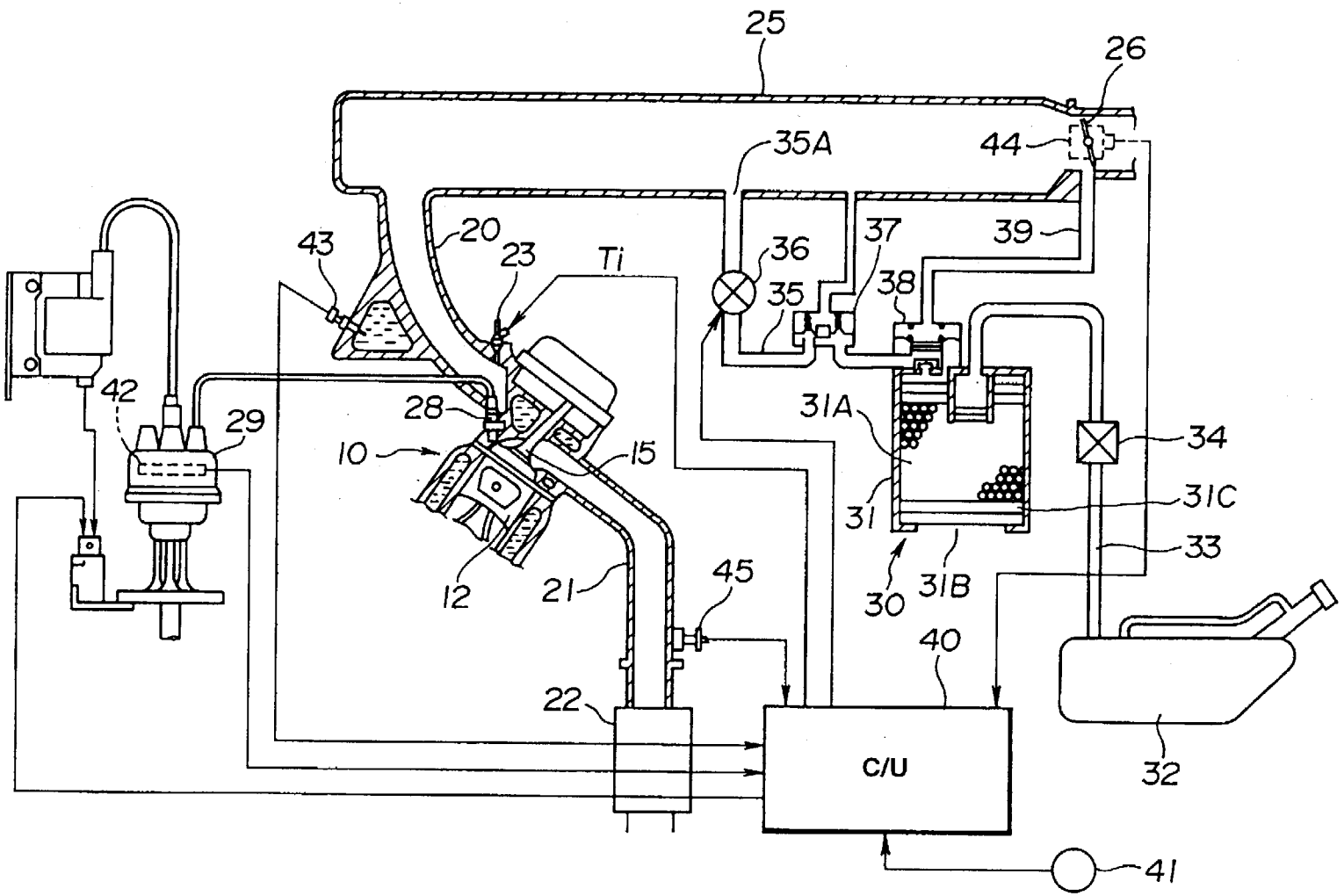
FIG. 1 is a schematic diagram showing one embodiment of an air/fuel ratio control apparatus made in accordance with the invention.

With reference to the drawings, and in particular to FIG. 1, there is shown a schematic diagram of an air/fuel ratio control apparatus embodying the invention. An internal combustion engine, generally designated by the numeral 10, for an automotive vehicle includes combustion chambers or cylinders, one of which is shown. A crankshaft (not shown) is supported for rotation with the engine 10 in response to reciprocation of the piston 12 within the cylinder. An intake manifold 20 is connected with the cylinder through an intake port with which an intake valve (not shown) is in cooperation for regulating the entry of combustion ingredients into the cylinder from the intake manifold 20. An exhaust manifold 21 is connected with the cylinder through an exhaust port with which an exhaust valve 15 is in cooperation for regulating the exit of combustion products, exhaust gases, from the cylinder into the exhaust manifold 21. The exhaust gases are discharged to the atmosphere through an exhaust duct having a three-way catalytic converter 22. The intake and exhaust valves are driven through a suitable linkage with the crankshaft.

A fuel injector 23 is mounted for injecting fuel into the intake manifold 20 toward the intake valve. The fuel injector 23 opens to inject fuel into the intake manifold 20 when it is energized by the presence of electrical signal Ti. The length of electrical pulse, that is, the pulse-width, applied to the fuel injector 23 determines the length of time the fuel injector 23 opens and, thus, determines the amount of fuel injected into the intake manifold 20. Air to the engine 10 is supplied through an air cleaner (not shown) into an induction passage 25. The amount Q of air permitted to enter the combustion chamber through the intake manifold 20 is controlled by a butterfly throttle valve 26 located within the induction passage 25. The throttle valve 26 is connected by a mechanical linkage to an accelerator pedal (not shown). The degree to which the accelerator pedal is depressed controls the degree of rotation of the throttle valve 26. A spark plug 28 is mounted in the top of the cylinder for igniting the combustion ingredients within the cylinder when the spark plug 28 is energized by the presence of high voltage electrical energy to be supplied at appropriate intervals from a distributor 29.

The engine 10 is associated with a fuel vapor purging unit, generally designated by the numeral 30, which includes a fuel vapor trap such as an activated carbon canister 31 employing an absorbent 31A, such for example as activated charcoal, for accumulating or absorbing fuel vapor introduced thereinto from a fuel tank 32. For this purpose, the canister 31 has an inlet port connected through an fuel vapor passage 33 to the upper space of the fuel tank 32. The fuel vapor passage 33 has a check valve 34 which permits the fuel vapor to flow from the fuel tank 32 to the canister 31 when the fuel vapor pressure exceeds a predetermined value while preventing back-flow. The canister 31 also has an outlet port connected through a purge passage 35 terminating in a purge port 35A which opens into the induction passage 25 at a position downstream of the throttle valve 26. The purge passage 35 has purge-adjustment and -cut valves 36 and 37 situated therein for controlling the flow of purged gases (air/fuel mixture) through the purge passage 35. The purge adjustment valve 36 may be of the type associated with a stepper motor which operates on a command fed thereto from the control unit 40 to vary the position of the purge adjustment valve 36 to adjust the effective area of the purge passage 35. The purge cut valve 37 operates on a command fed thereto from the control unit 40 to move between open and closed positions. The purge cut valve 37 is open to permit relatively unrestricted flow through the purge passage 35 when the throttle valve 26 is open and it is closed to block flow through the purge passage 35 when the throttle valve 26 is closed fully. The canister 31 has a purge or purging air inlet 31B connected to the atmosphere through a filter 31C. A flow control valve 38, which is provided in the purge passage 35, operates on a command from a control unit 40 to open and close the purge passage 35. The flow control valve 38 operates in response to a negative pressure introduced thereinto through a conduit 39 which opens into the induction passage 25 near the throttle valve 26. Thus, the flow control valve 38 opens at intermediate engine loads where the negative pressure introduced through the conduit 39 increases with respect to the intake manifold negative pressure introduced into the purge passage 35. When the flow control valve 38 opens, fresh air is introduced through the purge air inlet 31B to purge the fuel vapor absorbed by the absorbent 31A. The purged fuel vapor is introduced, along with the air, through the purge passage 35 to the induction passage 25.

The amount of fuel metered to the engine, this being determined by the width of the electrical pulse Ti applied to the fuel injector 23 is repetitively determined from calculations performed by the control unit 40, these calculations being based upon various conditions of the engine that are sensed during its operation. The effective area of the purge passage 35, this being determined by the position of the stepper motor associated to control the position of the purge adjustment valve is repetitively determined from calculations performed by the control unit 40, these calculations being based upon various conditions of the engine that are sensed during its operation. These conditions include intake air flow rate Qa, engine speed Ne, engine coolant temperature Tw, throttle valve position and oxygen content. Thus, an airflow meter 41, a crankshaft position sensor 42, an engine coolant temperature sensor 43, a throttle position sensor 44 and an oxygen sensor 45 are connected to the control unit 40.

The flow meter 41 is provided to detect the amount Qa of air permitted to enter the induction passage 25 and it produces a signal indicative of the detected intake air flow rate Qa. The crankshaft position sensor 42 produces a series of crankshaft position electrical pulses, each corresponding to one degree of rotation of the engine crankshaft, of a repetition rate directly proportional to engine speed Ne and a reference electrical pulse Ref at a predetermined number of degrees (for example, 180° for four-cylinder engines and 120° for six-cylinder engines). The engine coolant temperature sensor 43 is provided to sense the temperature Tw of the engine coolant and it produces a signal indicative of the sensed engine coolant temperature. The throttle position sensor 44 is associated with the throttle valve 26 and it produces a signal when the throttle valve 26 is at its closed position. The oxygen sensor 45 is located in the engine exhaust duct to provide a feedback signal used to ensure that the fuel supplied to the engine is correct to maintain a desired optimum air/fuel ratio.

The control unit 40 may employ a digital computer which includes a central processing unit (CPU), a random access memory (RAM), a read only memory (ROM), and an input/output control unit (I/O). The central processing unit communicates wit the rest of the computer via data bus. The input/output control unit includes a counter which counts the reference pulses fed from the crankshaft position sensor 42 and converts its count into an engine speed indication digital signal for application to the central processing unit. The input/output control unit also includes an analog-to-digital converter which receives analog signals from the airflow meter 41 and other sensors and converts them into digital form for application to the central processing unit. The read only memory contains the program for operating the central processing unit and further contains appropriate data in look-up tables used in calculating appropriate value for fuel delivery requirements and purge rates. Control words specifying desired fuel delivery requirements and purge rates are periodically transferred by the central processing unit to the fuel-injection and purge control circuits included in the input/output control unit. The fuel injection control circuit converts the received control words into a fuel injection pulse signal for application to the fuel injector 23. The fuel injector 23 opens for a time period determined by the width of the fuel injection control pulse signal so as to bring the sensed or actual air/fuel ratio into coincidence with a target air/fuel ratio value calculated by the computer. The purge control circuit causes the stepper motor to make a change in the position Of the flow control valve 36, if this is required, so as to adjust the purged gas flow rate according to the intake air flow rate.

Figure 2:
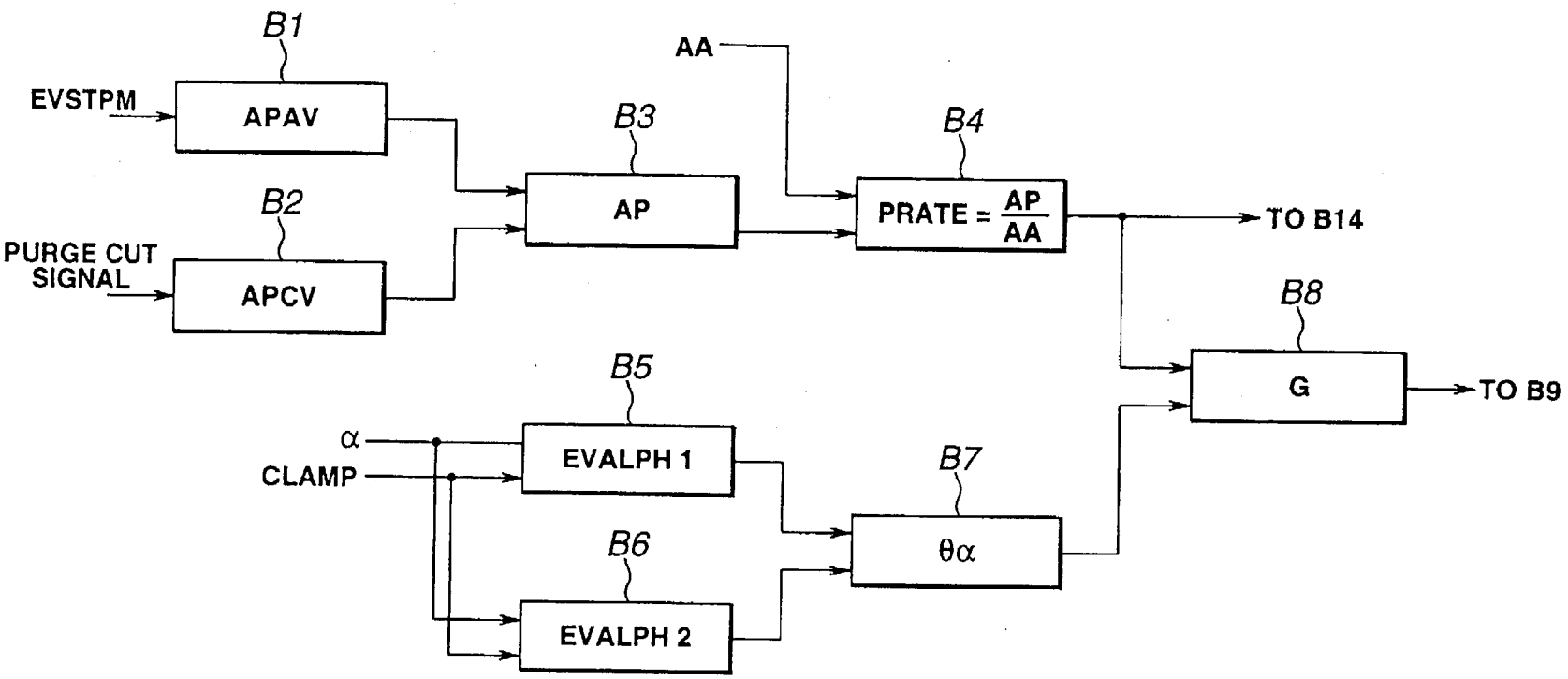
FIGS. 2 and 3 are block diagrams used in explaining the operation of the air/fuel ratio control apparatus of FIG. 1.
Figure 3:
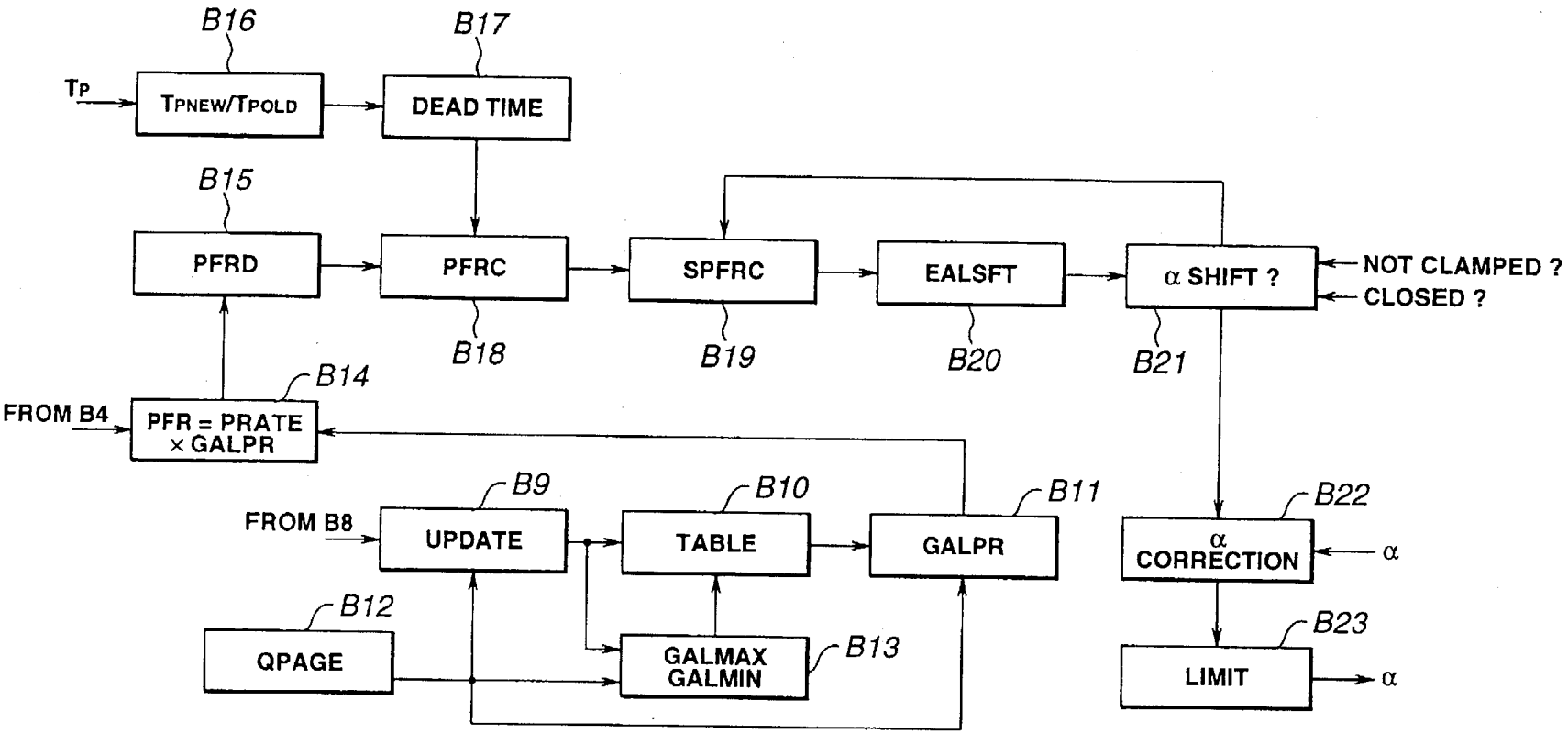

Referring to FIGS. 2 and 3, there are shown various functions performed by the control unit 40. In the first block B1, the effective purge passage area APAV resulting from the stepper motor position EVSTPM associated with the purge adjustment valve 36 is calculated based on the monitored stepper motor position EVSTPM. This calculation is made with the use of a table TAPAV programmed into the computer. The table TAPAV defines the effective purge passage area APAV as a function of stepper motor position EVSTPM. The block B2 monitors the purge cut signal fed from the control unit 40 to close the purge cut valve 36 and calculates the effective purge passage area APCV resulting from the position of the purge cut valve 37. The block B3 receives the calculated effective purge passage areas APAV and APCV and selects a smaller one of these purge passage areas APAV and APCV. Since the purge adjustment and cut valves 36 and 37 are provided in series with each other in the purge passage 35, the smaller one effective purge passage area represents the true effective area of the purge passage 35. The selected purge passage area is outputted as an effective purge passage area AP to the lock B4 which also receives a total effective purge passage area AA to calculate an actual purge rate PRATE as PRATE=AP/AA. The total effective purge passage area AA is the effective area of the purge passage 35 when the purge adjustment valve 36 is determined by the degree of opening of the throttle valve 26. The calculated actual purge rate PRATE is fed to the block B8 and also to the block B14.

The block B5 receives an air/fuel ratio feedback correction factor α calculated with fuel vapor purge, that is, when the purge cut valve 37 opens to permit the fuel vapor purge and it calculates a weighted average value EVALPH1 of the received air/fuel ratio feedback correction factors α. In this case, the weighted average value EVALPH1 has an initial value 100% and it is retained during a period where an open loop control is performed for the air/fuel ratio or the air/fuel ratio feedback correction factor α is clamped. Thus, the output of the block B5 is 100% or the calculated weighted average value. The block B6 receives the air/fuel ratio feedback correction factor α calculated without fuel vapor purge, that is, when the purge cut valve 37 is closed to inhibit the fuel vapor purge and it calculates a weighted average value EVALPH2 of the received air/fuel ratio feedback correction factors α. In this case, the weighted average value EVALPH2 has an initial value 100%. The block B7 receives an input from the block B5 and another input from the block B6 and it calculates a deviation θα between the air/fuel ratio feedback correction factor α calculated with fuel vapor purge and the air/fuel ratio feedback correction factor calculated without fuel vapor purge. For example, the deviation θα may be given as θα=100%−EVALPH1.

Figure 9:
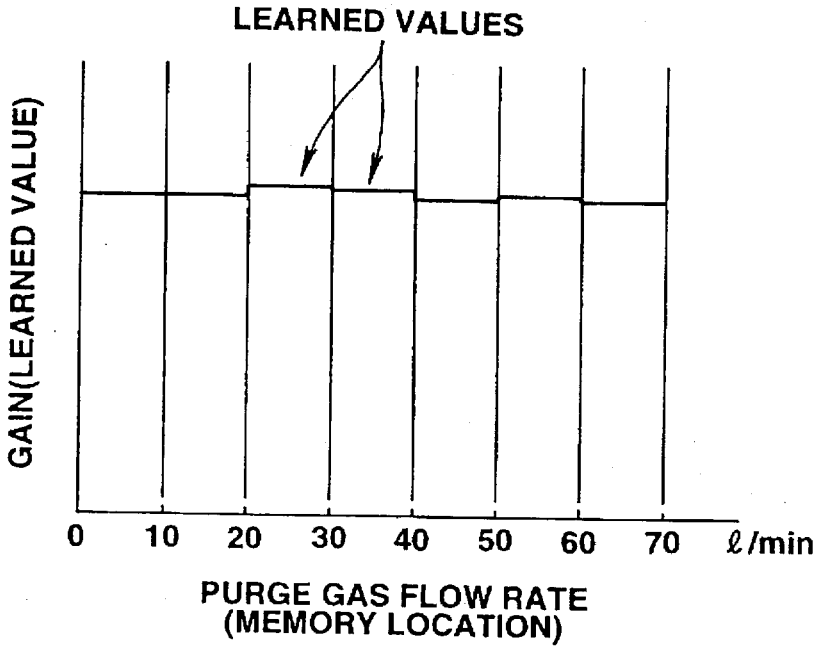
FIG. 9 is a diagram illustrating one example of memory for storing calculated gain values in respective memory locations specified by purge gas flow rate.
Figure 10:
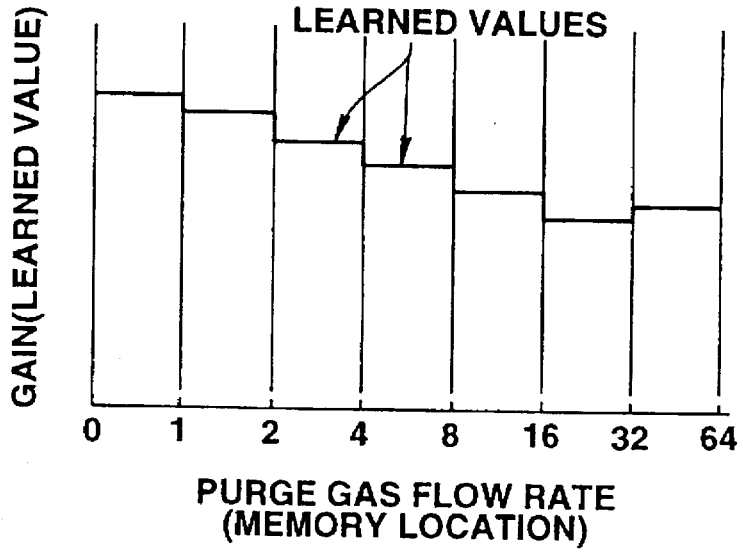
FIG. 10 is a diagram illustrating another example of memory for storing calculated gain values in respective memory locations specified by purge gas flow rate.
Figure 11:
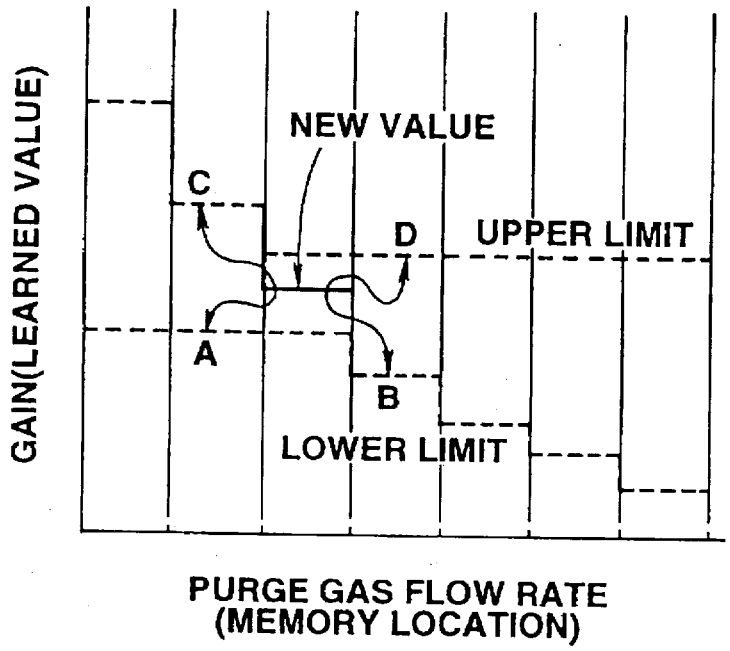
FIG. 11 is a diagram used in explaining upper and lower limits for the calculated gain values stored in the memory in respective memory locations specified by purge gas flow rate.
Figures 12A, 12B, 12C, 12D, 12E, 12F, 12G, 12H, 12I, 12J:
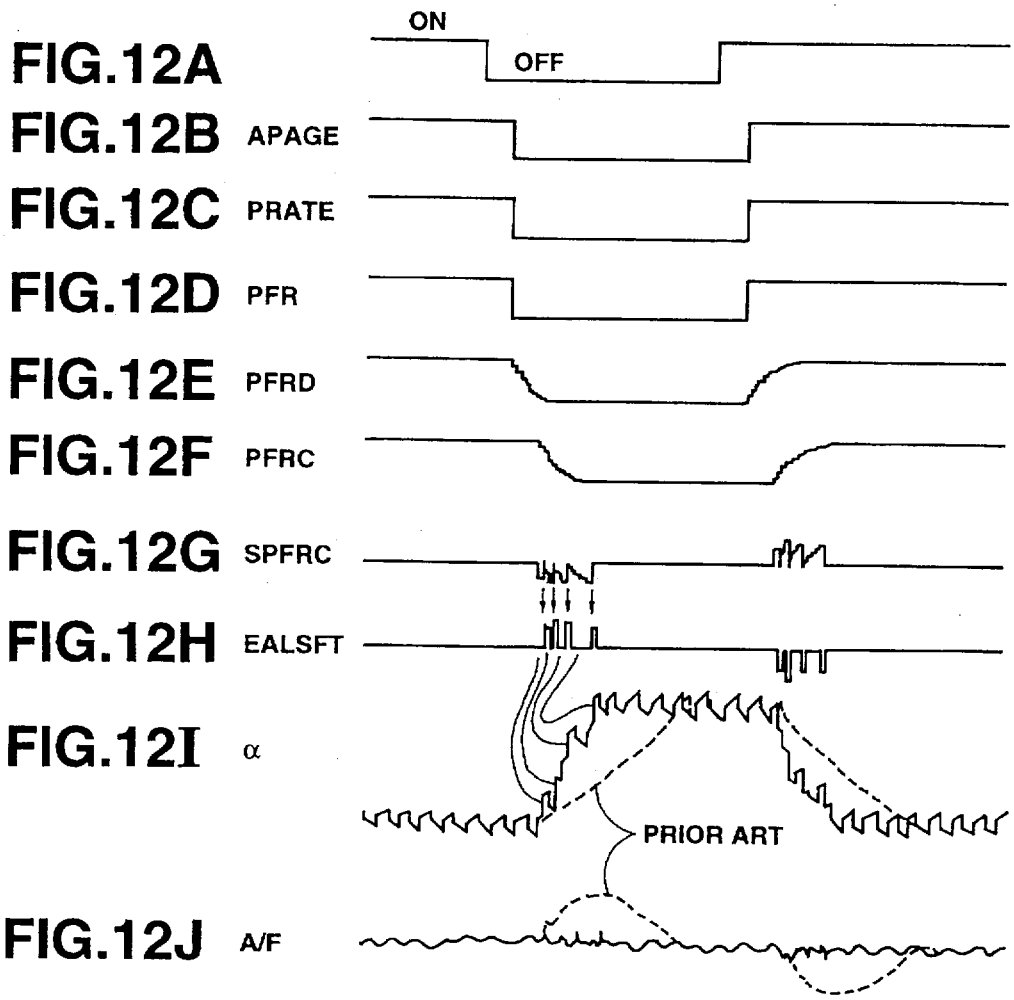
PRIOR ART FIG.12J
FIGS. 12A to 12J are graphs showing various parameter changes made with time during the air/fuel ratio control.

The block B8 receives the actual purge rate PRATE transferred thereto from the block B4 and the deviation θα transferred thereto from the block B7 and it calculate a gain G as G=θα/PRATE. The calculated gain G is transferred from the block B8 to the block B9. The block B9 also receives the existing purge gas flow rate corresponding area QPAGE fed from the block B12 to use the transferred gain value G to update the old gain value stored in a table TGALPR (block B10) which have memory locations addressable by different purge gas flow rates, as shown in FIG. 9. The purge gas flow rate QPAGE is given as QPAGE 32 AP/KPB where AP is the effective purge passage area and KPB is the differential pressure correction factor. The table TGALPH is retained on the power from the car battery after interruption of the power to the control unit 40. The learned value GTBL stored in the table TGALPH in the memory location specified by the purge gas flow rate corresponding area QPAGE is given as:

$$GTBL=GNEW\times X+GTBL_{n-1}(1-X)$$

where GNEW is the new gain value transferred from the block B8, $GTBL_{n-1}$ is the old gain value, and X is a weighted average coefficient. When the table TGALPH is not retained at the start of the engine or when the engine coolant temperature Tw is less than a predetermined value TWGAC at the start of the engine, an initial value INGALP is stored in the table TGALPH in all of the memory locations. The gain value updating or learning operation is permitted only when four conditions are fulfilled, that is, when (a) the duty correction factor KDUTY is equal to 1.0, (b) the actual purge rate PRATE is equal to or greater than a first reference value GPRATE, (c) the target purge rate EVPTR is equal to or greater than a second reference value GEVPTR, and (d) it is the first updating operation after the proportional term P is added during the air/fuel ratio feedback control upon the occurrence of the three conditions (a), (b) and (c). The table TGALPH may be arranged to store calculated gain values in its memory locations specified by fuel vapor amounts (fuel vapor flow rates) increasing exponentially, as shown in FIG. 10. This is effective to reduce the number of the memory locations required for the air/fuel ratio control. After the value GTBL is stored in the table TGALPR in the most recent purge gas flow rate corresponding area QPAGE, the block B13 limits the values stored in the table TGALPR in the memory locations other than that specified by the most recent purge gas flow rate corresponding area PAGE between upper and lower limits GALMAX and GALMIN. The upper limit GALMAX is set at a first value GALMAX1 (increasing exponentially as x2, $x2^2$, . . . ), as indicated by the broken line C of FIG. 11, when the purge gas flow rate corresponding area APAGE is less than the most recent purge gas flow rate corresponding area and at a second value GALMAX2 (=GTBL×ULSUI where GTBL is the new gain value and ULSUI is the upper limit gain), as indicated by the broken line D of FIG. 11, when the purge gas flow rate corresponding area QPAGE is greater than the most recent purge gas flow rate corresponding area. The lower limit GALMIN is set at a first value GALMIN1 (=GTBL×ULSUI where GTBL is the new gain value and ULSUI is the upper limit gain), as indicated by the broken line A of FIG. 11, when the purge gas flow rate corresponding area QPAGE is less than the most recent purge gas flow rate corresponding area and at a second value GALMIN2 (decreasing exponentially as x½, $x½^2$, . . . ), as indicated by the broken line B of FIG. 11, when the purge gas flow rate corresponding area APAGE is less than the most recent purge gas flow rate corresponding area.

In the block B11, the purge gas flow rate corresponding area QPAGE fed from the block B12 is used to read a learned gain value GALPR from the table TGALPR. The central processing unit may be programmed in a known manner to interpolate between the data at different entry points. The block B14 receives the actual purge rate PRATE transferred from the block B4 and also the read gain value GALPH transferred from the block B11 and it estimates a purge concentration PFR as PFR=PRATE×GALPH. The estimated purge concentration value PFR is transferred from the block B14 to the block B15 where a weighted average PFRD is calculated to provide an approximation of the purge gas diffusion within the intake manifold 20 from the following equation:

$$PFRD=PFR\times PDMANI+PFRD_{n-1}(1-PDMANI)$$

where PDMANI is a weighted average coefficient.

The block B16 calculates the rate of change of the basic fuel-injection pulse-width value Tp as TpNEW/TpOLD where TpNEW and TpOLD are the new and last basic fuel-injection pulse-width values sampled subsequently at intervals of the air/fuel ratio feedback control job. This calculated rate TpNEW/TpOLD is transferred from the block B16 to the block B17 which calculates a dead time for shortening the delay of the charged air in the intake manifold 20 based on the rate TpNEW/TpOLD. The block B18 receives the weighted average PFRD fed from the block B15 and also the calculated dead time fed from the block B17 and it calculates the purge concentration PFRC, that is, the concentration of the purged gases contained in the air/fuel mixture supplied into the engine cylinder as $PFRC=PFRD_{n-NDLYPR}$ where n is determined based on the rate TpNEW/TpOLD.

The block B19 calculates an accumulated purge concentration change value SPFRC from the following equation:

$$SPFRC=SPFRC_{n-1}+(PFRC-PFRC_{n-1})$$

where $SPFRC_{n-1}$ is the last value calculated for the accumulated purge concentration change and it decreases toward zero bit by one bit for each of the purge concentration accumulated value decrease exponential number of times. In the block B20, an evapo α shift correction factor EALSFT is calculated as EALSFT=−GALSFT (±) where GALSFT is the α shift reflection gain. The maximum value of |EALSFT| is limited to an upper α shift correction factor limit EALMAX.

The air/fuel ratio correction factor α is corrected or shifted only when the three conditions are fulfilled, that is, when (a) |EALSFT|≧ALSON where ALSON is an α shift addition discriminating α value, (b) the air/fuel ratio feedback control is performed with the correction factor being not clamped and (c) both of the airflow meter 41 and the throttle sensor 44 are operating in order. The block 21 make a decision as to whether or not these three conditions are fulfilled. In the block B21, a decision is made as to whether or not these three conditions are fulfilled. When any one of these three conditions is fulfilled, the evapo α shift correction factor EALSFT is set at zero. When the three conditions are fulfilled, in the block B22, the most recent air/fuel ratio feedback correction factor α is calculated from the following equation:

$$\alpha=\alpha 0\pm 1\pm P+EALSFT$$

where α0 is the last air/fuel ratio feedback control correction factor value, I is the integral term, P is the proportional term and EALSFT is the evapo α shift correction factor to be described later. In the block B23, the calculated air/fuel ratio feedback control correction factor α is limited between upper and lower limits. The limited air/fuel ratio feedback control correction factor α is transferred from the block B23 for use in calculating the fuel injection pulse width Ti.

Figure 4:
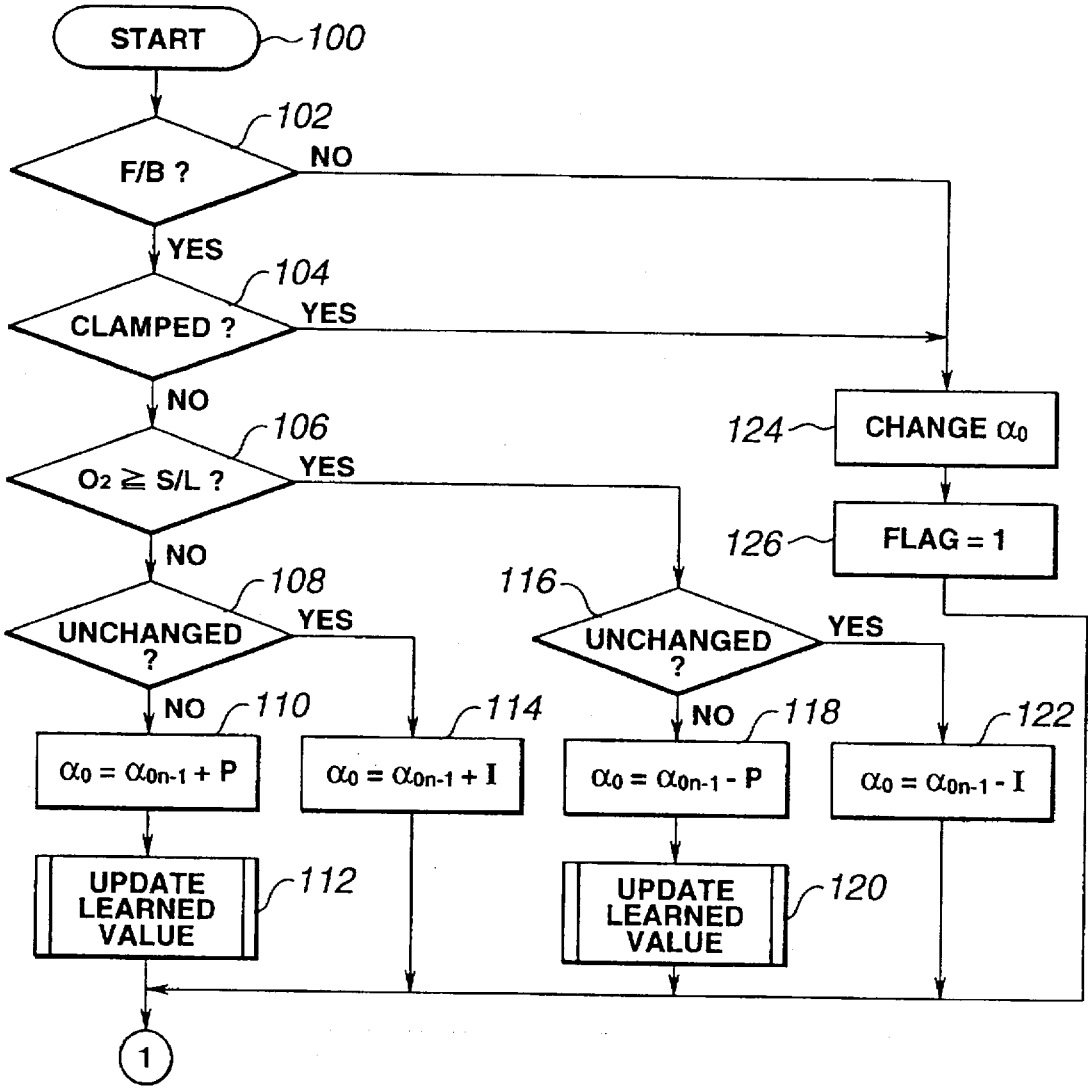
FIGS. 4 and 5 are flow diagrams illustrating the programming of the digital computer used in the air/fuel ratio control apparatus of FIG. 1.
Figure 5:
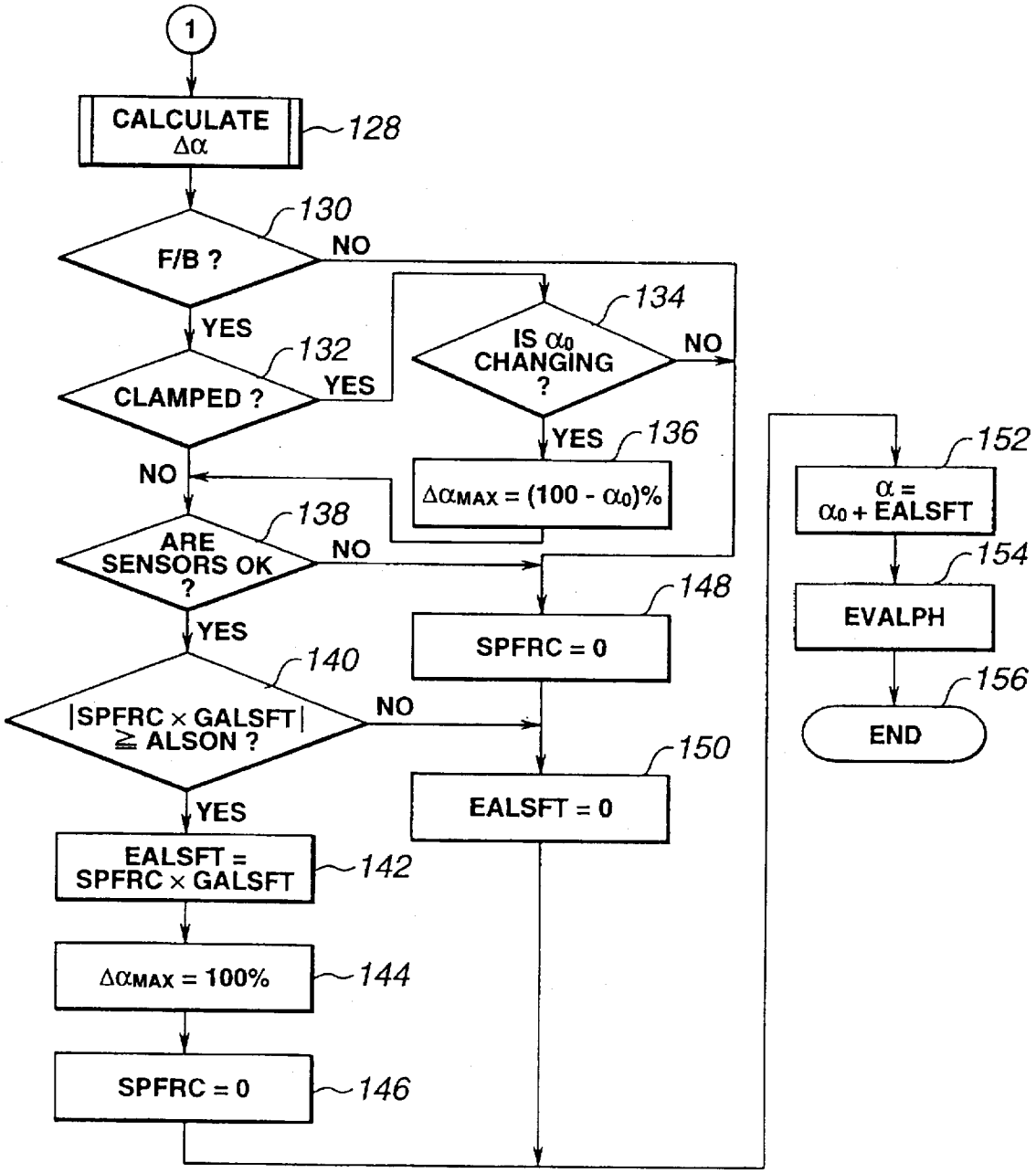

FIGS. 4 and 5 are flow diagram showing the programming of the digital computer as it is used for air/fuel ratio feedback control. The computer program is entered at the point 100 at intervals corresponding one rotation of the engine. At the point 102 in the program, a determination is made as to whether or not the engine operating conditions are fulfilled for the air/fuel ratio feedback control (F/B). If the answer to this question is "yes", then the program proceeds to the point 104. Otherwise, the program proceeds to the point 124. At the point 104, a determination is made as to whether or not the engine operating conditions are fulfilled for clamping the air/fuel ratio feedback control correction factor α. If the answer to this question is "yes", then the program proceed to the point 106. Otherwise, the program proceeds to the point 124. At the point 106, a determination is made as to whether or not the output $O_2$ of the oxygen sensor 45 is equal to or greater than a slice level S/L. If the answer to this question is "yes", then the program proceeds to the point 108. Otherwise, the program proceeds to the point 116.

At the point 108 in the program, a determination is made as to whether or not the new value of the output $O_2$ of the oxygen sensor 45 is unchanged from the last value thereof. If the answer to this question is "no", then the program proceeds to the point 110 where the last value α0 of the air/fuel ratio feedback correction factor α is calculated as:

$$\alpha 0=\alpha 0_{n-1}+P$$

wherein $\alpha 0_{n-1}$ is the last value of α0 calculated in the last cycle of execution of this program and P is the proportional term. At the point 112, the learned value is updated in such a manner as described later. Following this, the program proceeds to the point 128 (FIG. 5). If the new value of the output $O_2$ of the oxygen sensor 45 is unchanged from the last value thereof, then the program proceeds to the point 114 where the last value $\alpha 0$ of the air/fuel ratio feedback correction factor $\alpha$ is calculated as:

$$\alpha 0=\alpha 0_{n-1}+I$$

wherein $\alpha 0_{n-1}$ is the last value of $\alpha 0$ calculated in the last cycle of execution of this program and I is the integral term. Following this, the program proceeds to the point 128.

At the point 116 in the program, a determination is made as to whether or not the new value of the output $O_2$ of the oxygen sensor 45 is unchanged from the last value thereof. If the answer to this question is "no", then the program proceeds to the point 118 where the last value $\alpha 0$ of the air/fuel ratio feedback correction factor $\alpha$ is calculated as:

$$\alpha 0=\alpha 0_{n-1}-P$$

wherein $\alpha 0_{n-1}$ is the last value of $\alpha 0$ calculated in the last cycle of execution of this program and P is the proportional term. At the point 120, the learned value is updated in such a manner as described later. Following this, the program proceeds to the point 128. If the new value of the output $O_2$ of the oxygen sensor 45 is unchanged from the last value thereof, then the program proceeds to the point 122 where the last value $\alpha 0$ of the air/fuel ratio feedback correction factor $\alpha$ is calculated as:

$$\alpha 0=\alpha 0_{n-1}-I$$

wherein $\alpha 0_{n-1}$ is the last value of $\alpha 0$ calculated in the last cycle of execution of this program and I is the integral term. Following this, the program proceeds to the point 128.

At the point 124 in the program, the last value $\alpha 0$ is changed toward 100%. At the point 126, a flag is set to 1 when the last value $\alpha 0$ is changing. Following this, the program proceeds to the point 128.

At the point 128, the value $\Delta\alpha$ by which the air/fuel ratio correction factor $\alpha$ is to be shifted is calculated in such a manner as described later. At the point 130 in the program, a determination is made as to whether or not the engine operating conditions are fulfilled for the air/fuel ratio feedback control (F/B). If the answer to this question is "yes", then the program proceeds to the point 132. Otherwise, the program proceeds to the point 148. At the point 132, a determination is made as to whether or not the engine operating conditions are fulfilled for clamping the air/fuel ratio feedback control correction factor $\alpha$. If the answer to this question is "yes", then the program proceed to the point 134. Otherwise, the program proceeds to the point 138.

At the point 134 in the program, a determination is made as to whether or not the value $\alpha 0$ is changing. This determination is made by reference to the flag (point 126). If the answer to this question is "yes", then the program proceeds to the point 136. Otherwise, the program proceeds to the point 148. At the point 136, the maximum value $\Delta\alpha$MAX for the value $\Delta\alpha$ by which the air/fuel ratio correction factor $\alpha$ is to be shifted is calculated as:

$$\Delta\alpha MAX=(100-\alpha 0)\%$$

Following this, the program proceeds to the point 138.

At the point 138 in the program, both of the airflow meter 41 and the throttle sensor 44 are operating in order. If the answer to this question is "yes", then the program proceeds to the point 140. Otherwise, the program proceeds to the point 148. At the point 140, a determination is made as to whether or not $|SPFRC\times GALSFT|\geqq ALSON$. If the answer to this question is "yes", then it means that the evapo $\alpha$ shift correction factor EALSFT (=−SPFRC×GALSFT) is equal to or greater than the reference value ALSON and the program proceeds to the point 142. Otherwise, the program proceeds to the point 150. At the point 142 in the program, the evapo $\alpha$ shift correction factor EALSFT is calculated as EALSFT=−SPFRC×GALSFT. At the point 144, the maximum value $\Delta\alpha$MAX of the evapo $\alpha$ shift correction factor EALSFT is limited to 100%. At the point 146, the accumulated purge concentration change value SPFRC is set at zero. Following this, the program proceeds to the point 152.

At the point 148 in the program, the accumulated purge concentration change value SPFRC is set at zero. At the point 150, the evapo $\alpha$ shift correction factor EALSFT is set at zero. Following this, the program proceeds to the point 152 where the new value $\alpha$ of the air/fuel ratio feedback control correction factor is calculated as $\alpha=\alpha 0+$EALSFT where $\alpha 0=\alpha 0_{n-1}\pm I\pm P$. At the point 154, the weighted average value EVALPH of the air/fuel ratio feedback control correction factor $\alpha$ is calculated. The weighted average value EVALPH is used in calculating the deviation $\theta\alpha$ of the air/fuel ratio feedback control correction factor $\alpha$. The deviation $\theta\alpha$ of the air/fuel ratio feedback control correction factor $\alpha$ is calculated as $\theta\alpha$=100%−EVALPH. Following this, the program proceeds to the end point 156.

Figure 6:
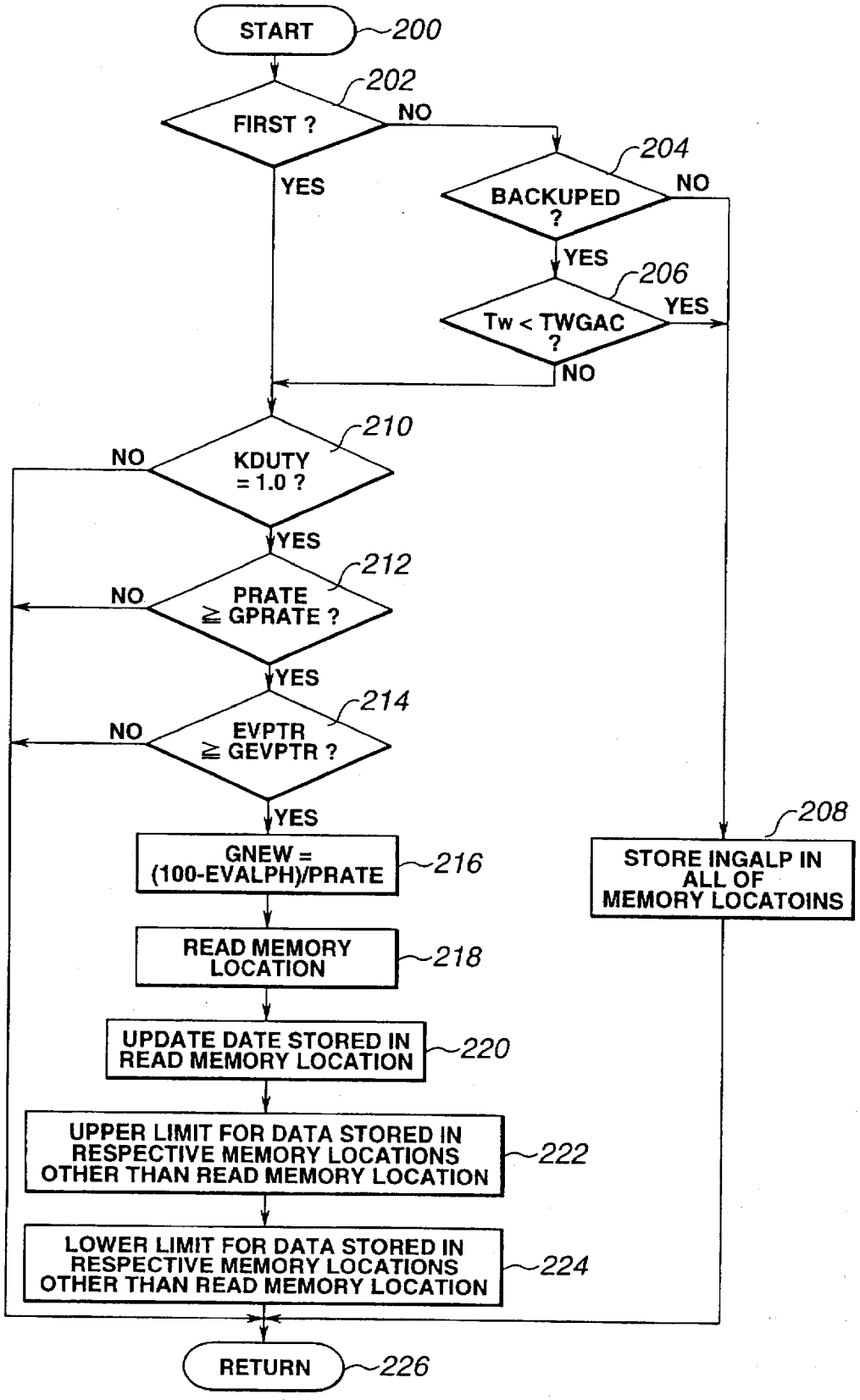
FIG. 6 is a flow diagram illustrating the programming of the digital computer as it is used for calculated gain learning operation.

FIG. 6 is a flow diagram illustrating the processes for updating the learned value. At the point 200 in FIG. 6, which corresponds to the point 112 or 120 of FIG. 4, the computer program is entered. At the point 202, a determination is made as to whether or not it is the first that the learned value is updated after the engine starts. If the answer to this question is "yes", then the program proceed to the point 204. Otherwise, the program proceeds to the point 210. At the point 204, a determination is made as to whether or not the table TGALPR is retained in the computer memory. If the answer to this question is "yes", then the program proceed to the point 206. Otherwise, the program proceeds to the point 208. At the point 206, a determination is made as to whether or not the engine coolant temperature Tw is lower than a predetermined value TWGAC. If the answer to this question is "yes", then the program proceeds to the point 208. Otherwise, the program proceeds to the point 210. At the point 208, an initial gain value INGALP is stored in the table TGALPR in all of the memory locations. Following this, the program proceeds to the end point 226 which corresponds to the point 128 of FIG. 5.

At the point 210 in the program, a determination is made as to whether or not a duty correction factor KDUTY is equal to 1.0. If the answer to this question is "yes", then the program proceeds to the point 212. Otherwise, the program proceeds to the end point 226. At the point 212, a determination is made as to whether or not the actual purge rate PRATE is equal to or greater than a reference value GPRATE. If the answer to this question is "yes", then the program proceeds to the point 214. Otherwise, the program proceeds to the end point 226. At the point 214, a determination is made as to whether or not the target purge rate EVPTR is equal to or greater than a reference value GEVPTR. If the answer to this question is "yes", then the program proceeds to the point 216. Otherwise, the program proceeds to the end point 226. That is, the learned gain value GALP is permitted to be updated during the fuel vapor purge when the duty correction factor KDUTY is equal to 1.0, the actual purge rate PRATE is equal to or greater than a reference value GPRATE, and the target purge rate EVPTR is equal to or greater than a reference value GEVPTR.

At the point 216 in the program, a new gain GNEW is calculated as GNEW=(100% −EVALPH)/PRATE where (100% −EVALPH) is the deviation $\theta\alpha$ of the air/fuel ratio feedback correction factor $\alpha$ and PRATE is the actual purge rate. The learned gain values GALPR are stored in the table TGALPA in memory locations specified as a function of purge gas flow rate. At the point 218, the memory location for which the learned gain value GALPR is to be updated is searched according to the purge gas flow rate QPAGE (=AP/KPB where KPB is the differential pressure correction factor). At the point 220 in the program, the learned value GTBL is updated in the memory location corresponding the most recent purge gas flow rate QPAGE as $GTBL=GNEW\times X+GTBL_{n-1}(1-X)$, as described in connection with the block diagram of FIGS. 2 and 3. After the learned value GTBL is updated, at the point 222, the minimum value Max for the learned value to be stored in another memory location is set. At the point. 226, the lower limit Min for the learned value to be stored in another memory location is set. The upper and lower limits Max and Min have been described in connection with the block diagram of FIGS. 2 and 3. Following this, the program proceeds to the end point 226 which corresponds to the point 128 of FIG. 5.

Figure 7:
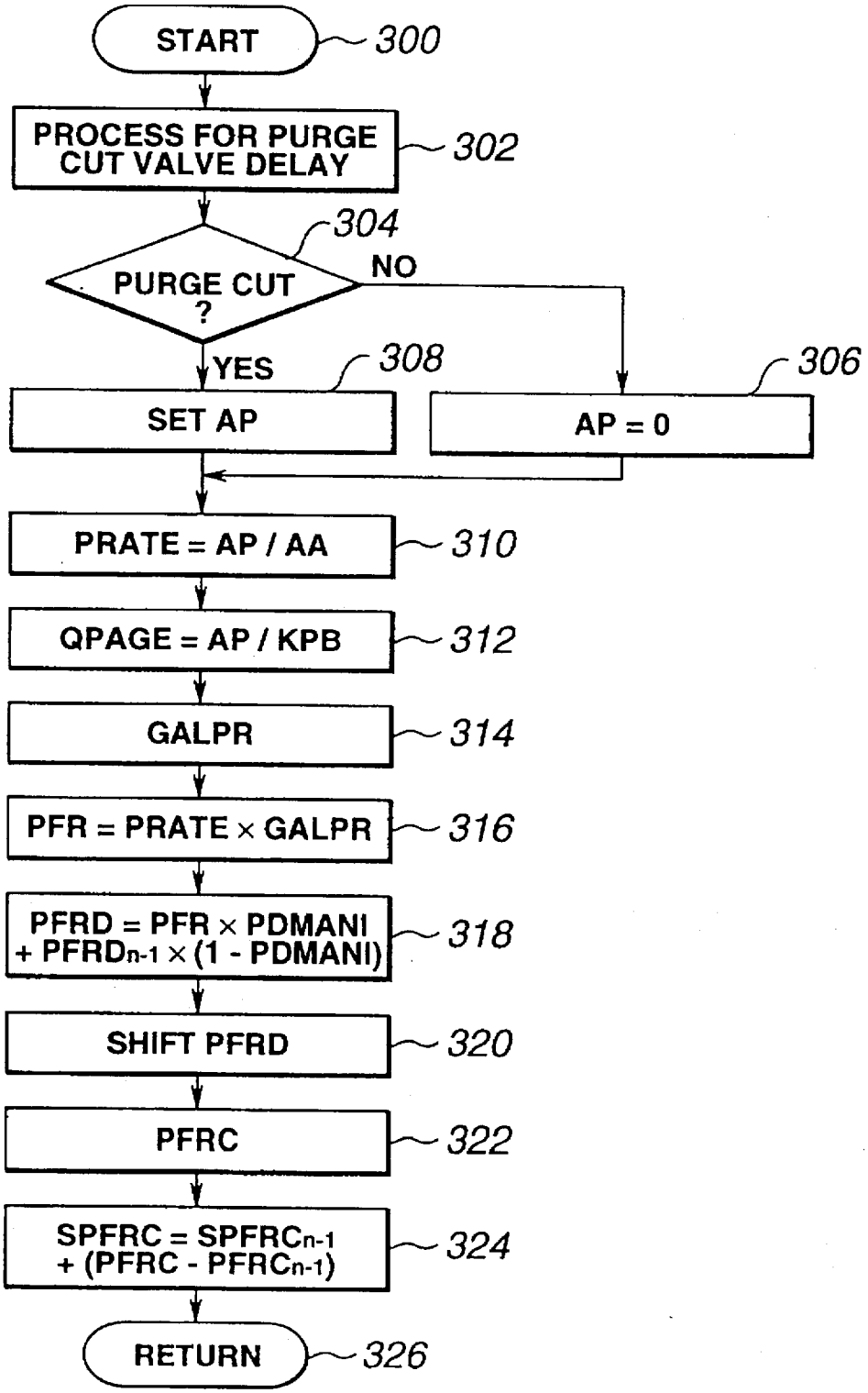
FIG. 7 is a flow diagram illustrating the programming of the digital computer as it is used for shift value calculation.

FIG. 7 is a flow diagram illustrating the programming of the digital computer as it is used to calculate the value $\Delta\alpha$ by which the air/fuel ratio feedback control correction factor $\alpha$ is to be shifted. At the point 300 in FIG. 7, which corresponds to the point 128 of FIG. 5, the computer program is entered. At the point 302 in the program, the delay of the purge cut valve 37 is processed. At the point 304, a determination is made as to whether or not the purge cut valve 37 is closed to interrupt the fuel vapor purge. If the answer to this question is "yes", then the program proceeds to the point 306 where the effective purge passage area AP is set at zero and then to the point 310. Otherwise, the program proceeds to the point 308 where the effective purge passage area AP is set at a smaller one of the effective area determined by the purge adjustment valve 36 and the effective area determined by the purge cut valve 37. Following this, the program proceeds to the point 310 where the actual purge rate RATE is calculated as PRATE=AP/AA where AP is the effective area of the purge passage 35 and AA is the total effective area of the purge passage 35 determined by the throttle valve position. At the point 312, the purge gas flow rate QPAGE is calculated as QPAGE=AP/KPB where KPB is a differential pressure correction factor. At the point 314, the learned gain value GALPR is calculated from the table TGALPR which defines this value as a function of purge gas flow rate QPAGE. At the point 316, an estimated purge concentration value PFR is calculated as PFR=PRATE×GALPR where PRATE is the actual purge rate calculated at the point 310 and the GALPR is the learned gain value GALPR calculated at the point 314. At the point 318, a smoothing process is made by calculating a weighted average of the estimated purge concentration value PFR to provide an approximation of the purged gas diffusion within the intake manifold 20 from the following equation:

$$PFRD=PFR\times PDMANI+PFRD_{n-1}(1-PDMANI)$$

where PDMANI is a weighted average coefficient.

At the point 320 in the program, the calculated weighted average PFRD is shifted. At the point 322, the concentration PFRC of the purge gas contained in the mixture supplied into the cylinder is set as $PFRC=PFRD_{n-NDLYPR}$) where NDLYPR is the number of the purge concentration delay cycles and n is a factor dependent on the rate of change of the basic fuel-injection pulse-width Tp per one cycle of execution of the air/fuel ratio feedback control.

Figure 13:
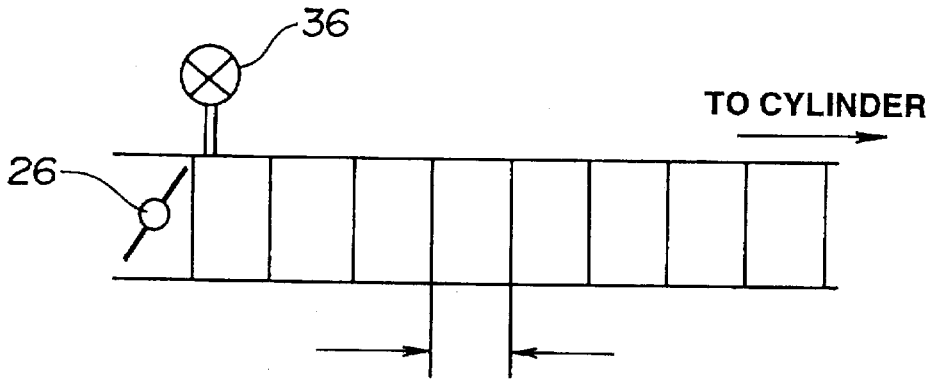
FIG. 13 is a diagram used in explaining the gas movement in the intake manifold.
Figure 14:
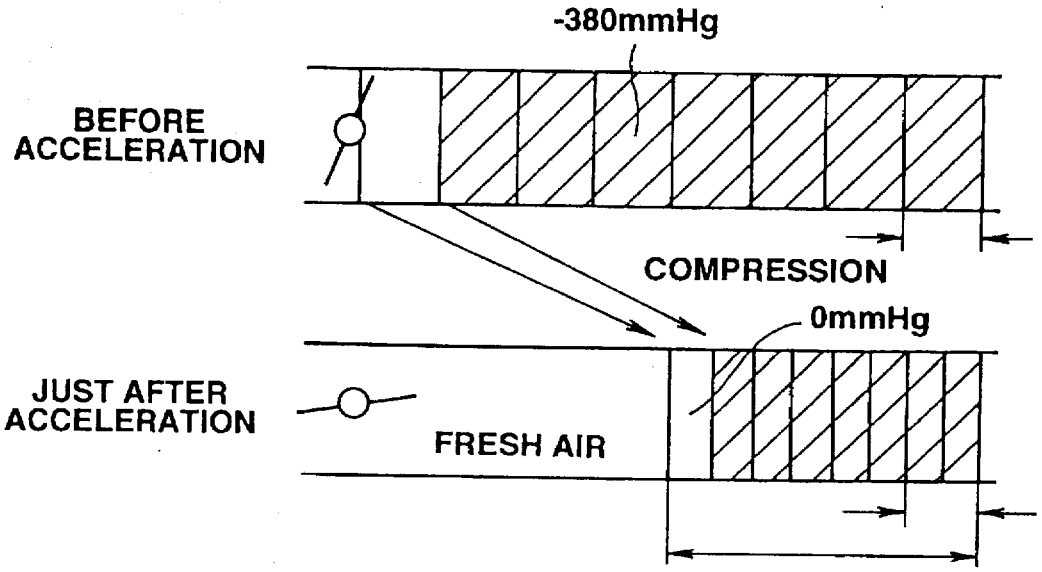
FIG. 14 is a diagram used in explaining the gas movement and compression during acceleration.

The purged gases supplied into the induction passage 25 at a position downstream of the throttle valve 26 are diffused in the intake manifold 20 and introduced into the engine cylinders with a delay. The movement of the gases in the intake manifold 20 is shown in FIG. 13. The movement of the gases within the induction passage while one intake stroke is completed for all of the cylinders corresonds to the produce of the stroke volume and the percentage of the fresh air contained in the gases. This delay is dependent on the boost pressure in the intake manifold 20 and the air/fuel ratio fluctuates during rapid acceleration or deceleration. FIG. 14 shows gas movement and compression during acceleration. The invention can minimize the delay by correcting the air/fuel ratio feedback correction factor based on a weighted average value of the purge concentration values calculated in sequence. In the illustrated case, the delay is reduced for a value corresponding to 8 times to a value corresponding to 4 times.

At the point 324, the accumulated purge concentration change value SPFRC is calculated as:

$$SPFRC=SPFRC_{n-1}+(PFRC-PFRC_{n-1})$$

where $SPFRC_{n-1}$ (the value calculated in the last cycle of execution of this program) is set as decreasing by one bit toward zero. Thus, the purge concentration change value is accumulated while the purge concentration value decreases. The character $PFRC_{n-1}$ is the value calculated in the last cycle of execution of this program. That is, the accumulated purge concentration value is calculated by accumulating the purge concentration values calculated in sequence while decreasing the calculated purge concentration values each time one calculated purge concentration value is accumulated. This is effective to correct the air/fuel ratio correction factor to meet with the actual requirements.

Figure 8:
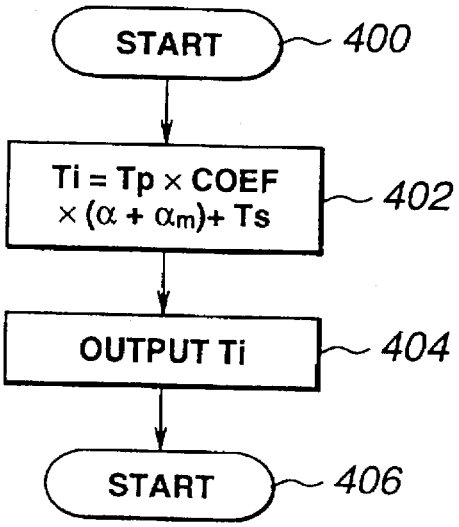
FIG. 8 is a flow diagram illustrating the programming of the digital computer as it is used for air/fuel ratio control.

FIG. 8 is a flow diagram illustrating the programming of the digital computer as it is used for fuel injection control. The computer program is entered at the point 400. At the point 402 in the program, a target value Ti for the fuel-injection pulse-width of the control signal Ti applied to the fuel injector 23 is calculated based on various engine operating conditions as $Ti=Tp\times COEF\times(\alpha+\alpha m)+Ts$ where Tp is the basic fuel-injection pulse-width value, COEF is a representative correction factor reflecting various correction factors determined based on various engine operating conditions, $\alpha$ is the air/fuel ratio feedback correction factor obtained during the execution of the program of FIGS. 4 and 5, $\alpha m$ is the learned air/fuel ratio value, and Ti is a vehicle battery voltage related correction factor. At the point 404, the calculated target value Ti is transferred to the input/output control unit which sets the fuel-injection pulse-width according to the calculated target value Ti. Following this, the program proceeds to the point 406 where the computer program is returned to the point 402.

FIGS. 12A to 12J show changes in the various parameters APAGE, PRATE, PFR, PFRD, PFRC, SPFRC and EALSFT, the air/fuel ratio correcting factor $\alpha$, and the air/fuel ratio A/F when the control unit 40 produces a purge cut signal switched ON and OFF to inhibit and permit the fuel vapor purge. According to the conventional air/fuel ratio feedback control, the air/fuel ratio is corrected to an excessive extent, as indicated by the broken curves of FIGS. 12I and 12J. The invention can eliminate such excessive air/fuel ratio correction by setting appropriate values by which the air/fuel ratio feedback correction factor $\alpha$ is shifted, as indicated by the solid curves of FIGS. 12I and 12J.

What is claimed is:

1. An apparatus for use with an internal combustion engine having a throttle valve located in an induction passage for controlling the amount of air supplied to the engine through the induction passage and an exhaust passage through which exhaust gases are discharged from the engine to the atmosphere, to control flow of fuel vapor purged from a fuel vapor trap into the engine through a purge passage having a purge control valve provided therein, comprising:

means for sensing engine operating conditions;

means for sensing an amount of air supplied into the engine;

means for sensing an air/fuel ratio of an air/fuel mixture supplied to the engine;

means for controlling the purge control valve to permit fuel vapor purge through the purge passage based on the sensed engine operating conditions;

means for calculating an air/fuel ratio feedback control correction factor to correct the air/fuel ratio within a predetermined range based on the sensed air/fuel ratio;

means for sensing an amount of fuel vapor introduced through the purge passage into the engine;

means for calculating a purge rate of the sensed fuel vapor amount with respect to the sensed air amount;

means for calculating a deviation between the air/fuel ratio feedback correction factor calculated with the fuel vapor purge and the air/fuel ratio feedback correction factor calculated without the fuel vapor purge;

means for calculating a gain value based on the calculated purge rate and the calculated air/fuel ratio feedback control correction factor deviation only during the fuel vapor purge;

a memory for storing gain values in respective memory locations addressable by different fuel vapor amounts;

means for storing the calculated gain value in the memory in a memory location corresponding to the sensed fuel vapor amount to update a gain value stored previously in the memory location;

means for reading a gain value stored in the memory in the memory location corresponding to the sensed fuel vapor amount;

means for calculating a value for the amount of fuel supplied to the engine based on the read gain value and the sensed engine operating conditions; and means for controlling the amount of fuel supplied to the engine according to the calculated value therefor.

2. The air/fuel ratio control apparatus as claimed in claim 1, further including means for setting an upper and lower limit for gain values to be stored in the memory in the respective memory locations.

3. The air/fuel ratio control apparatus as claimed in claim 2, wherein the limit setting means includes means for setting a first upper limit for gain values to be stored in the memory in respective memory locations specified by different fuel vapor amounts smaller than the sensed fuel vapor amount, the first upper limit being greater than the calculated gain value and increasing in inverse proportion to the fuel vapor amount, means for setting a second upper limit for gain values to be stored in the memory in the respective memory locations specified by different fuel vapor amounts greater than the sensed fuel vapor amount, the second upper limit being greater than the calculated gain value, means for setting a first lower limit for gain values to be stored in the memory in respective memory locations specified by different fuel vapor amounts smaller than the sensed fuel vapor amount, the first value being smaller than the calculated gain value, and means for setting a second lower limit for gain values to be stored in the memory in the respective memory locations specified by different fuel vapor amounts greater than the sensed fuel vapor amount, the second lower limit being smaller than the calculated gain value and decreasing in inverse proportion to the fuel vapor amount.

4. The air/fuel ratio control apparatus as claimed in claim 1, further including means for setting a limit for gain values to be stored in the memory in the respective memory locations.

5. The air/fuel ratio control apparatus as claimed in claim 4, wherein the limit setting means includes means for setting a first upper limit for gain values to be stored in the memory in respective memory locations specified by different fuel vapor amounts smaller than the sensed fuel vapor amount, the first upper limit being greater than the calculated gain value and increasing in inverse proportion to the fuel vapor amount, and means for setting a second upper limit for gain values to be stored in the memory in the respective memory locations specified by different fuel vapor amounts greater than the sensed fuel vapor amount, the second upper limit being greater than the calculated gain value.

6. The air/fuel ratio control apparatus as claimed in claim 4, wherein the limit setting means includes means for setting a first lower limit for gain values to be stored in the memory in respective memory locations specified by different fuel vapor amounts smaller than the sensed fuel vapor amount, the first value being smaller than the calculated gain value, and means for setting a second lower limit for gain values to be stored in the memory in the respective memory locations specified by different fuel vapor amounts greater than the sensed fuel vapor amount, the second lower limit being smaller than the calculated gain value and decreasing in inverse proportion to the fuel vapor amount.

7. The air/fuel ratio control apparatus as claimed in claim 1, wherein the memory has memory locations specified by fuel vapor amounts increasing exponentially.

8. The air/fuel ratio control apparatus as claimed in claim 7, further including means for setting an upper and lower limit for gain values to be stored in the memory in the respective memory locations.

9. The air/fuel ratio control apparatus as claimed in claim 8, wherein the limit setting means includes means for setting a first upper limit for gain values to be stored in the memory in respective memory locations specified by different fuel vapor amounts smaller than the sensed fuel vapor amount, the first upper limit being greater than the calculated gain value and increasing in inverse proportion to the fuel vapor amount, means for setting a second upper limit for gain values to be stored in the memory in the respective memory locations specified by different fuel vapor amounts greater than the sensed fuel vapor amount, the second upper limit being greater than the calculated gain value, means for setting a first lower limit for gain values to be stored in the memory in respective memory locations specified by different fuel vapor amounts smaller than the sensed fuel vapor amount, the first value being smaller than the calculated gain value, and means for setting a second lower limit for gain values to be stored in the memory in the respective memory locations specified by different fuel vapor amounts greater than the sensed fuel vapor amount, the second lower limit being smaller than the calculated gain value and decreasing in inverse proportion to the fuel vapor amount.

10. The air/fuel ratio control apparatus as claimed in claim 7, further including means for setting a limit for gain values to be stored in the memory in the respective memory locations.

11. The air/fuel ratio control apparatus as claimed in claim 10, wherein the limit setting means includes means for setting a first upper limit for gain values to be stored in the memory in respective memory locations specified by different fuel vapor amounts smaller than the sensed fuel vapor amount, the first upper limit being greater than the calculated gain value and increasing in inverse proportion to the fuel vapor amount, and means for setting a second upper limit for gain values to be stored in the memory in the respective memory locations specified by different fuel vapor amounts greater than the sensed fuel vapor amount, the second upper limit being greater than the calculated gain value.

12. The air/fuel ratio control apparatus as claimed in claim 10, wherein the limit setting means includes means for setting a first lower limit for gain values to be stored in the memory in respective memory locations specified by different fuel vapor amounts smaller than the sensed fuel vapor amount, the first value being smaller than the calculated gain value, and means for setting a second lower limit for gain values to be stored in the memory in the respective memory locations specified by different fuel vapor amounts greater than the sensed fuel vapor amount, the second lower limit being smaller than the calculated gain value and decreasing in inverse proportion to the fuel vapor amount.

13. An apparatus for use with an internal combustion engine having a throttle valve located in an induction passage for controlling the amount of air supplied to the engine through the induction passage and an exhaust passage through which exhaust gases are discharged from the engine to the atmosphere, to control flow of fuel vapor purged from a fuel vapor trap into the engine through a purge passage having a purge control valve provided therein, comprising:

means for sensing engine operating conditions;

means for sensing an amount of air supplied into the engine;

means for sensing an air/fuel ratio of an air/fuel mixture supplied to the engine;

means for controlling the purge control valve to permit fuel vapor purge through the purge passage based on the sensed engine operating conditions;

means for calculating an air/fuel ratio feedback control correction factor to correct the air/fuel ratio within a predetermined range based on the sensed air/fuel ratio;

means for sensing an amount of fuel vapor introduced through the purge passage into the engine;

means for calculating a purge rate of the sensed fuel vapor amount with respect to the sensed air amount;

means for calculating a deviation between the air/fuel ratio feedback correction factor calculated with the fuel vapor purge and the air/fuel ratio feedback correction factor calculated without the fuel vapor purge;

means for calculating a gain value based on the calculated purge rate and the calculated air/fuel ratio feedback control correction factor deviation only during the fuel vapor purge;

a memory for storing gain values in respective memory locations addressable by different fuel vapor amounts;

means for storing the calculated gain value in the memory in a memory location corresponding to the sensed fuel vapor amount to update a gain value stored previously in the memory location;

means for reading a gain value stored in the memory in the memory location corresponding to the sensed fuel vapor amount;

means for calculating a shift value by which the air/fuel ratio feedback control correction factor is to be shifted based on the read gain value and the calculated purge rate;

means for shifting the air/fuel ratio feedback control correction factor by the calculated shift value;

means for calculating a value for the amount of fuel supplied to the engine based on the shifted air/fuel ratio feedback control correction factor and the sensed engine operating conditions; and means for controlling the amount of fuel supplied to the engine according to the calculated value therefor.

14. The air/fuel ratio control apparatus as claimed in claim 13, wherein the gain value calculating means includes means for calculating the gain value by dividing the calculated air/fuel ratio feedback control correction factor deviation by the calculated purge rate, and wherein the shift value calculating-means includes means for calculating a purge concentration value, repetitively at uniform intervals, by multiplying the calculated gain value by the calculated purge rate, memory means for storing a predetermined number of most recent purge concentration values calculated in sequence, means for calculating an accumulated purge concentration value by accumulating the purge concentration values calculated in sequence while decreasing the calculated purge concentration values each time one calculated purge concentration value is accumulated, and means for setting the shift value at the accumulated purge concentration value.

15. The air/fuel ratio control apparatus as claimed in claim 13, wherein the gain value calculating means includes means for calculating the gain value by dividing the calculated air/fuel ratio feedback control correction factor deviation by the calculated purge rate, and wherein the shift value calculating means includes means for calculating a purge concentration value, repetitively at uniform intervals, by multiplying the calculated gain value by the calculated purge rate, memory means for storing a predetermined number of most recent purge concentration values calculated in sequence, means for repetitively calculating a weighted average value of the purge concentration values calculated in sequence, and means for calculating an accumulated purge concentration value by accumulating the calculated weighted average values while decreasing the calculated weighted average values each time one calculated weighted average value is accumulated, and means for setting the shift value at the accumulated weighted average value.

16. The air/fuel ratio control apparatus as claimed in claim 13, wherein the gain value calculating means includes means for calculating the gain value by dividing the calculated air/fuel ratio feedback control correction factor deviation by the calculated purge rate, and wherein the shift value calculating means includes means for calculating a purge concentration value, repetitively at uniform intervals, by multiplying the calculated gain value by the calculated purge rate, memory means for storing a predetermined number of most recent purge concentration values calculated in sequence, means for repetitively reading the oldest purge concentration value from the memory means, means for calculating an accumulated purge concentration value by accumulating the purge concentration values read in sequence while decreasing the read purge concentration values each time one read purge concentration value is accumulated, and means for setting the shift value at the accumulated purge concentration value.

17. The air/fuel ratio control apparatus as claimed in claim 13, wherein the gain value calculating means includes means for calculating the gain value by dividing the calculated air/fuel ratio feedback control correction factor deviation by the calculated purge rate, and wherein the shift value calculating means includes means for calculating a purge concentration value, repetitively at uniform intervals, by multiplying the calculated gain value by the calculated purge rate, memory means for storing a predetermined number of most recent purge concentration values calculated in sequence, means for repetitively reading the oldest purge concentration value from the memory means, means for repetitively calculating a weighted average value of the purge concentration values read in sequence, means for calculating an accumulated purge concentration value by accumulating the weighted average values calculated in sequence while decreasing the calculated weighted average values each time one calculated weighted average value is accumulated, and means for setting the shift value at the accumulated weighted average value.

* * * * *